US005456083A

United States Patent [19]

Hogg et al.

[11] Patent Number: 5,456,083

[45] Date of Patent: Oct. 10, 1995

[54] AIR SEPARATION APPARATUS AND METHOD

[75] Inventors: Neil Hogg, Summit; Mark Leskowicz, Flemington, both of N.J.

[73] Assignee: The BOC Group, Inc., New Providence, N.J.

[21] Appl. No.: 249,483

[22] Filed: May 26, 1994

[51] Int. Cl.[6] ..... F25J 3/02

[52] U.S. Cl. ..... 62/25; 62/38; 62/41

[58] Field of Search ..... 62/25, 31, 38, 62/41, 44

[56] References Cited

U.S. PATENT DOCUMENTS

| | | | |
|---|---|---|---|
| Re. 33,026 | 8/1989 | Petit et al. | 62/36 |
| 3,754,406 | 8/1973 | Allam | 62/41 |
| 4,330,307 | 5/1982 | Coury | 62/31 X |
| 4,372,764 | 2/1983 | Theobald | 62/41 X |
| 4,699,209 | 10/1987 | Thorogood | 165/110 |
| 4,732,597 | 3/1988 | Jujasz et al. | 62/24 |
| 4,790,866 | 12/1988 | Rathbone | 62/22 |
| 5,098,456 | 3/1992 | Dray et al. | 62/38 X |
| 5,108,476 | 4/1992 | Dray et al. | 62/24 |
| 5,122,174 | 6/1992 | Sunder et al. | 62/24 |
| 5,228,296 | 7/1993 | Howard | 62/40 X |
| 5,245,832 | 9/1993 | Roberts | 62/24 |
| 5,251,449 | 10/1993 | Rottmann | 62/41 X |
| 5,251,451 | 10/1993 | Xu et al. | 62/25 |
| 5,265,429 | 11/1993 | Dray | 62/41 |
| 5,341,646 | 8/1994 | Agrawal et al. | 62/25 |

FOREIGN PATENT DOCUMENTS

59857/90 1/1991 Australia .

OTHER PUBLICATIONS

W. F. Castle, Modern Liquid Pump Oxygen Plants: Equipment and Performance, *AIChE Symposium Series* No. 294, vol. 89, pp. 14–17.

*Primary Examiner*—Christopher Kilner

*Attorney, Agent, or Firm*—David M. Rosenblum; Larry R. Cassett

[57] ABSTRACT

An air separation apparatus and method in which a high pressure gaseous product is produced as a liquid, pumped to a delivery pressure and then vaporized prior to its discharge as product. In order to accomplish the requisite vaporization, a subsidiary stream of incoming air is compressed by a booster compressor and then passed into indirect heat exchange with the pumped liquid in a falling film evaporator. The falling film evaporator maintains an essentially constant temperature difference between the air and falling film, formed of the pumped liquid. As a result, a very small temperature differences can be maintained as compared with the conventional use of a thermosyphon reboiler. As a result, less booster compression is required for the subsidiary air stream over a prior art plant.

9 Claims, 1 Drawing Sheet

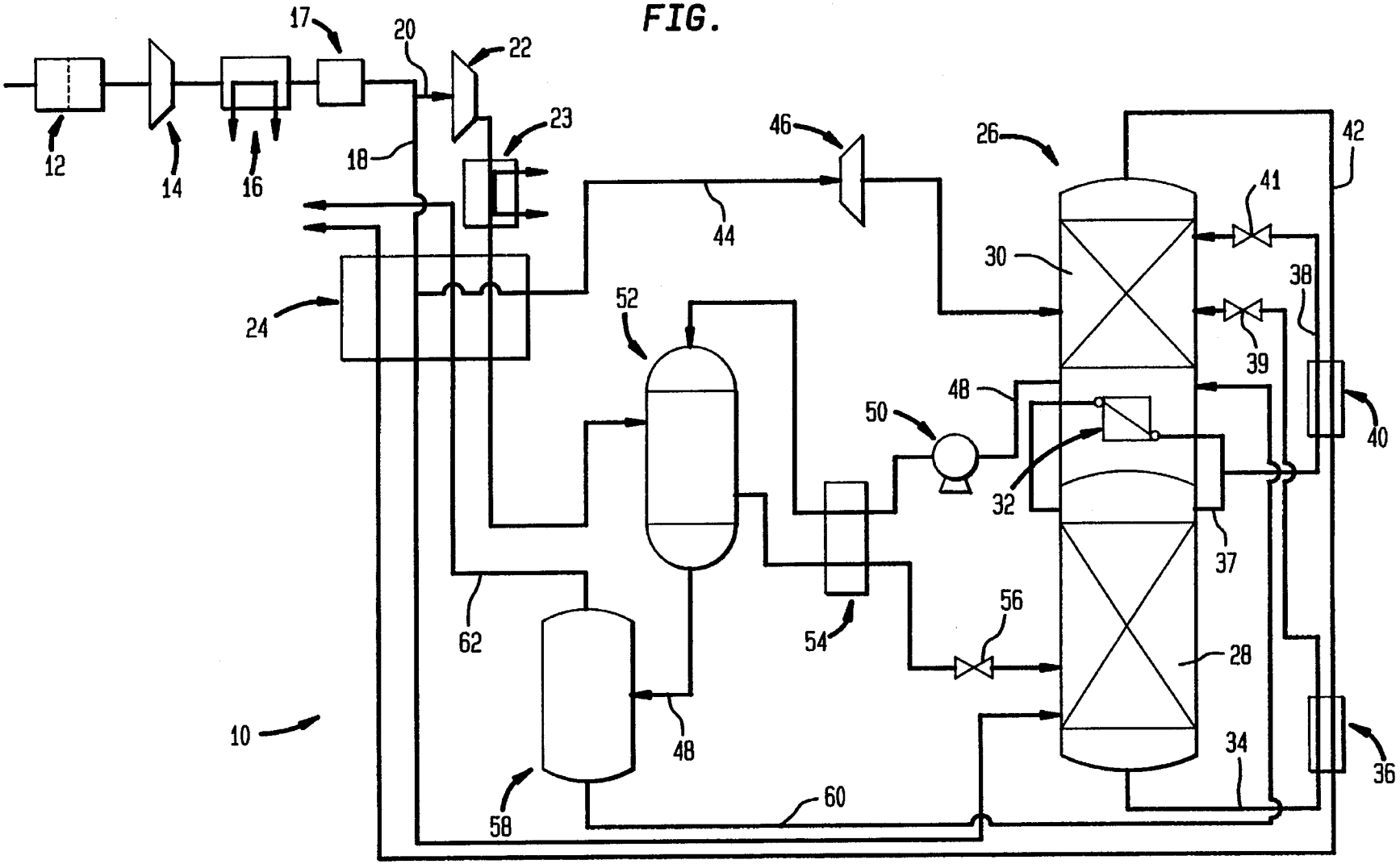
FIG.

AIR SEPARATION APPARATUS AND METHOD

BACKGROUND OF THE INVENTION

The present invention relates to a method of separating air by cryogenic distillation to produce a gaseous product at a high delivery pressure. More particularly, the present invention relates to such an apparatus and method in which the product is oxygen and in which the oxygen as a liquid is pumped to the high delivery pressure prior to its vaporization and delivery.

Air is separated into its components, for instance oxygen, nitrogen, argon and etc., at low temperatures within one or more distillation columns. Typically, after filtering of the air to remove particulate material, the air is compressed, the heat of compression is removed, and the air is then purified. Purification is commonly effectuated by an adsorbent system to remove carbon dioxide and hydrocarbons. Thereafter, the air is cooled to at or near its dewpoint in a main heat exchanger and is introduced into a distillation column. The distillation column contains trays or packing to contact descending liquid and ascending vapor phases of the air. As a result of such contact, the ascending vapor becomes ever more concentrated in the more volatile components of the air, for instance nitrogen, and the descending liquid phase becomes ever more concentrated in the less volatile components of the air, for instance, oxygen.

Two columns, connected in a heat transfer relationship, are used to produce both higher purity liquid oxygen and nitrogen products. Although there is some demand for the nitrogen product to be delivered at pressure, it is more commonly required that the oxygen product be delivered at high pressure. In order to deliver an oxygen product at high pressure, liquid oxygen from a lower pressure column is pumped to the delivery pressure and is then vaporized against a portion of the incoming air to produce a gaseous product at pressure which is discharged at ambient temperature from the warm side of the main heat exchanger. Very often, a thermosyphon type heat exchanger is interposed between the main heat exchanger and the lower pressure column in order to effectuate vaporization of the liquid oxygen.

In order for the liquid oxygen to be vaporized by the air, the portion of the air that is used for this purpose is sufficiently compressed by a booster compressor that a temperature difference will be maintained between the air and the liquid oxygen product to be vaporized. The head of the oxygen to be vaporized within a thermosyphon reboiler is, however, not constant. As result, the boiling temperature of the liquid oxygen increases to a maximum at an intermediate location of the boiler. In order to maintain the requisite temperature difference throughout the thermosyphon reboiler, the pressure of the incoming air must be sufficiently boosted to maintain a temperature difference between the air and the maximum temperature.

As will be discussed, the present invention provides an apparatus and method in which linear temperature difference characteristics are preserved between the incoming air and liquid oxygen product to be vaporized so that a minimum temperature difference between the air and the oxygen can be maintained. This in turn, allows less compression than a prior art apparatus and method and therefore, a concomitant savings in energy.

SUMMARY OF THE INVENTION

The present invention provides an apparatus for separating air to produce a product at a delivery pressure enriched in a component of the air. In accordance with the apparatus, an air stream composed of the air to be separated is filtered in filtering means and is then compressed in a compression means. A first heat exchange means is provided for removing heat of compression from the air and a purification means is connected to the first heat exchange means for purifying the air. A booster compression means is provided for boosting pressure of the air above the delivery pressure. The booster compression means is connected to the purification means so that the air stream is divided into a subsidiary air stream boosted in pressure and a main air stream not boosted in pressure. A second heat exchange means is provided for removing heat of compression from the subsidiary air stream. A main heat exchange means is connected to the purification means and the second heat exchange means for cooling the main and subsidiary air streams so that at least the main air stream is fully cooled to a temperature suitable for its rectification and a vaporized product stream composed of the product is fully warmed. In this regard, the terms "fully cooling" as used herein and in the claims means cooling to a temperature of the cold side of the main heat exchanger. The term "fully warming" as used herein the claims, means warming to the temperature of the warm side of the main heat exchanger which most air separation plants is at ambient temperature.

Also provided is an air separation unit for receiving the main and subsidiary air streams. The air separation unit is configured to separate the air and thereby to produce the product as a liquid. A pump is connected to the air separation unit for pumping a product stream composed of the liquid to the delivery pressure. A falling film evaporator is connected to the pump and interposed between the main heat exchange means and the air separation unit. The falling film evaporator is configured such that a falling film is formed from the product stream which is brought into indirect heat exchange with the air contained within the subsidiary air stream. The product stream is at least partially vaporized, thereby to at least partially vaporize the product. As a result of the indirect heat exchange, the subsidiary air stream is further cooled while maintaining an essentially constant temperature difference between the air and the falling film. The falling film evaporator is in communication with the main heat exchange means so that the product from the falling film evaporator enters the main heat exchanger as the vaporized product stream, fully warms therein and is discharged therefrom at substantially the delivery pressure. The term "substantially" is used herein and in the claims to account for piping losses.

In accordance with another aspect of the present invention, a method of separating air is provided to produce a product at a delivery pressure an enriched in a component of the air. In accordance with the method, an air stream composed of the air to be separated is filtered and compressed. The heat of compression is removed from the air stream, and then, the air stream is purified. The air stream is then divided into main and subsidiary air streams. The subsidiary air stream is compressed to a boosted pressure above the delivery pressure and the heat of compression is removed from the subsidiary air stream. The main air stream is cooled to a temperature suitable for its rectification. The air contained within the main and subsidiary air streams is separated in an air separation unit to produce the product as a liquid. A product stream composed of the liquid is then pumped to the delivery pressure. A falling film is formed from the product stream and heat is indirectly exchanged between the falling film and the air contained within the subsidiary air stream within a falling film evaporator so that the product stream is at least partially vaporized, thereby to at least partially vaporize the product. The subsidiary air stream is further cooled and an essentially constant temperature difference between the air and the falling film is maintained. The subsidiary air stream after having been further cooled is separated within the air separation unit. The product after having been at least partially vaporized is formed into the vaporized product stream which is thereafter fully warmed and then discharged.

The present invention utilizes a falling film evaporator also, known in the art as a "downflow reboiler". It consists of parallel plates which separate the liquid and vapor flows. In order to maximize the film area, corrugations are provided between plates. An essential characteristic of a falling film evaporator as compared with a thermosyphon reboiler, is that the heat exchange occurs at a constant temperature difference between the film and the vapor, from the top to the bottom of such a heat exchanger. As a result, the temperature difference between the film and the air can be in a range of between about 0.3° K. and about 1.0° K. as compared with 2.0° K. in a thermosyphon reboiler. Due to this very narrow temperature difference, the air, although boosted in pressure, is less boosted than an equivalent prior art device employing a thermosyphon reboiler.

BRIEF DESCRIPTION OF THE DRAWINGS

While the specification concludes with claims distinctly pointing out the subject matter that applicants regard as their invention, it is believed that the invention will be better understood when taken in connection with the accompanying sole figure, which is a schematic representation of an apparatus and method in accordance with the present invention.

DETAILED DESCRIPTION

With reference to the figure, a schematic representation of an apparatus 10 is illustrated for carrying out a method in accordance with the present invention. In accordance with apparatus 10 air is filtered in a manner well known in the art to remove solid particulates by a filter 12. Thereafter, the air is compressed by a compressor 14 and the heat of compression is removed by an after-cooler 16, which can be of the water cooled type. The resultant air stream after purification within a purification unit 17 is then divided into a main stream 18 and a subsidiary air stream 20. A booster compressor 22 boosts the pressure of the subsidiary air stream 20 above the delivery pressure and an after-cooler 23 is employed to remove the heat of compression. The main air stream 18 is not boosted in pressure. Both air streams are then cooled within a main heat exchanger 24.

Although main heat exchanger 24 is illustrated as a single block, as would be known to those skilled in the art, main heat exchanger 24 might be a complex of plate-fin heat exchangers. Furthermore, although subsidiary air stream 20 is illustrated as being fully cooled, it preferably is less cooled than main air stream 18 which is fully cooled to a temperature suitable for its rectification. As will be discussed, subsidiary air stream 20 will be further cooled and then subcooled after main heat exchanger 24.

Both main and subsidiary air streams 18 and 20 are rectified or separated into oxygen and nitrogen enriched fractions within a double column air separation unit 26. Air separation unit 26 is conventional and when the term "double column air separation unit" as used herein and in the claims, will be understood to mean, as illustrated, a higher pressure column 28 operatively associated with a lower pressure column 30 by a condenser-reboiler 32 of the thermosyphon-type. Higher and lower pressure columns 28 and 30 either contain trays, sieve plates, structured packing, or ordered or random packing to bring ascending vapor and descending liquid phases of the air into intimate contact with one another so that the descending liquid phase becomes evermore concentrated in oxygen and the ascending vapor phase becomes ever more concentrated in nitrogen. This produces, within higher pressure column 28, a rich liquid column bottom and a nitrogen enriched tower overhead. A rich liquid stream 34, composed of the column bottom, is removed from higher pressure column 28, subcooled within subcooler 36, and reduced to the pressure of lower pressure column 30 by a Joule-Thompson valve 37. Thereafter, rich liquid stream 34 is introduced into lower pressure column 30 for further refinement. Such further refinement produces liquid oxygen which collects as a column bottom in lower pressure column 30. The liquid oxygen is boiled against condensing the nitrogen enriched tower overhead produced within higher pressure column 28. The nitrogen enriched tower overhead is removed as a poor liquid stream 38, which after having been subcooled in subcooler 40, is reduced in pressure to the pressure of lower pressure column 30 by a Joule-Thompson valve 41 and introduced into lower pressure column 30 as reflux. The nitrogn enriched tower overhead is also returned in part to higher pressure column 28 as reflux stream 39. Waste nitrogen, which collects as a tower overhead in lower pressure column 30, is removed as a waste nitrogen stream 42 which is partially warmed in subcoolers 36 and 40 against subcooling rich liquid and poor liquid streams 34 and 38 respectfully. Thereafter, waste nitrogen stream 42 is fully warmed within main heat exchanger 24 to help cool the incoming air. Waste nitrogen stream 42 is then expelled from apparatus 10.

In order to maintain an energy balance in apparatus 10, due to heat leakage and other thermodynamic irreversibilities, a stream is divided off of main air stream 18 after partial cooling of main air stream 18 to produce a refrigerant stream 44. Refrigerant stream 44 is turboexpanded within a turboexpander 46 and introduced into low pressure column 30. It is to be noted that Applicant's invention is not limited to an air expansion plant and would have equal applicability to plants in which refrigeration were externally supplied such as in well known nitrogen assist plants or plants employing refrigeration generated from nitrogen as in nitrogen expansion plants.

A product stream 48 is removed from the bottom of the lower pressure column 30 which consists of liquid oxygen collected in a sump of lower pressure column 30. I an alternative embodiment, the product stream could be composed of liquid nitrogen which would be subsequently pumped and then vaporized. In the illustrated embodiment, product stream 48 is pumped by a pump 50 to the requisite delivery pressure and is introduced into falling film evaporator 52. Falling film evaporator 52 has parallel plates and corrugated packing between the plates. The liquid oxygen, pumped to its delivery pressure, falls within falling film evaporator 52 as a falling film. At the same time, subsidiary air stream 20 after having been cooled within main heat exchanger 24 is introduced into falling film evaporator 52 and is cooled against the evaporation of product stream 48.

Although the present invention has applicability to a mode of operation in which product stream 48 were fully vaporized within falling film evaporator 52, it is preferable that the flow rates of product stream 48 and subsidiary air stream 20 be adjusted so that there is an excess of product stream 48. As a result, product stream 48 is only partially vaporized within falling film evaporator 52. This mode of operation is preferred in order to prevent heavy impurities such as carbon dioxide and hydrocarbons from vaporizing and collecting within main heat exchanger 24

Subsidiary air stream 20 is further cooled by its heat exchange with the liquid oxygen and is subcooled in a subcooler 54 against the warming of product stream 48 after having been pumped by pump 50. Subsidiary air stream 20 is then reduced in pressure by a Joule-Thompson valve 56 and introduced into higher pressure column 28 for rectification.

Product stream 48, in a partially evaporated state after falling film evaporator 52, is introduced into a phase separator 58 which separates product stream 48 into liquid and vapor phases. The liquid phase, as a liquid phase stream 60, is introduced into lower pressure column 30. The vapor phase is extracted from phase separation tank 58 as a vaporized product stream 62 which is then fully warmed within main heat exchanger 24 and is expelled as the gaseous oxygen product.

EXAMPLE

The following chart is a calculated example of an operation of apparatus 10 in accordance with the present invention where a plant producing 160 TPD at 95% purity has an overall power saving of 1.6% over the prior art. In this calculated example higher pressure column 28 was simulated as having 21 theoretical stages. The average pressure for equipment 28 was 4.95 atmospheres. Main air stream 18 entered on stage 21 and subsidiary air stream 20 entered on stage 15. The lower pressure column 30 was simulated as having 20 theoretical stages. The average pressure for equipment 30 was 1.333 atmospheres. Rich liquid stream 34 entered on stage 12 and poor liquid stream entered on stage 1. The refrigerant stream 44 entered on stage 16.

CHARTED EXAMPLE

| Stream | Vapor fraction | Temperature Centigrade | Pressure atm | Molar Flow sm3/hr | Nitrogen mole fraction | Argon mole fraction | Oxygen mole fraction |
|---|---|---|---|---|---|---|---|
| Subsidiary Air Stream 20 Before Main Heat Exchanger 24 (After Aftercooler 23) | 1.0000 | 32.78 | 6.2 | 6270.5 | 0.7811 | 0.0093 | 0.2096 |
| Subsidiary Air Stream 20 After Main Heat Exchanger 24 | 1.0000 | −171.91 | 6.1 | 6270.5 | 0.7811 | 0.0093 | 0.2096 |
| Subsidiary Air Stream 20 After Subcooler 54 | 0.0000 | −179.01 | 6.1 | 6270.5 | 0.7811 | 0.0093 | 0.2096 |
| Subsidiary Air Stream 20 After J-T Valve 56 | 0.0000 | −179.0 | 4.90 | 6270.5 | 0.7811 | 0.0093 | 0.2096 |
| Product Stream 48 After Pump 50 | 0.0000 | −180.47 | 3.0 | 9420.2 | 0.0105 | 0.0289 | 0.9606 |
| Product Stream 48 After Subcooler 54 | 0.0000 | −176.95 | 3.0 | 9420.2 | 0.0105 | 0.0289 | 0.9606 |
| Product Stream 48 After Partial Vaporization Within Falling Film Evaporator 52 | 0.5000 | −174.39 | 2.38 | 9420.2 | 0.0105 | 0.0289 | 0.9606 |
| Vaporized Product Stream 62 After Main Heat Exchanger 24 | 1.0000 | 34.00 | 2.2 | 4710.6 | 0.0168 | 0.0341 | 0.9491 |
| Liquid Phase Stream 60 | 0.0000 | −174.38 | 2.3 | 4710.1 | 0.0051 | 0.0237 | 0.9712 |

While the invention has been described with reference to a preferred embodiment, as will occur to those skilled in the art, numerous changes, additions, and omissions can be made without changing the spirit and scope of the present invention.

We claim:

1. An apparatus for separating air to produce a product at a delivery pressure and enriched in a component of the air, said apparatus comprising:

filtering means for filtering an air stream composed of the air to be separated compression means for compressing said air stream composed of the air;

first heat exchange means for removing heat of compression from the air;

purification means connected to the heat exchange means for purifying the air;

booster compression means for boosting pressure of the air above the said delivery pressure, said booster compression means connected to said purification means so that said air stream is divided into a subsidiary air stream boosted in pressure and a main air stream not boosted in pressure;

second heat exchange means for removing heat of compression from said subsidiary air stream;

main heat exchange means connected to the purification means and said second heat exchange means for cooling the main and subsidiary air streams so that at least the main air stream is fully cooled to a temperature suitable for its rectification and a vaporized product stream composed of the product is fully warmed;

an air separation unit receiving the main and subsidiary air streams and configured to separate the air and thereby to produce the product as a liquid;

a pump connected to the air separation unit for pumping a product stream composed of the liquid to the delivery pressure; and a falling film evaporator connected to the pump, interposed between said main heat exchange means and said air separation unit, and configured such that a falling film formed from said product stream is brought into indirect heat exchange with the air contained within said subsidiary air stream, partially vaporizing said product stream, thereby to partially vaporize the product, and further cooling said subsidiary air stream while maintaining an essentially constant temperature difference between said air and said falling film; and a phase separation tank connected to said falling film evaporator to separate vapor and liquid phases of the product;

the phase separation tank also connected to the main heat exchange means and the lower pressure column so that a liquid phase stream composed of the liquid phase flows into the air separation unit and the vaporized product stream composed of the vapor phase flows to the main heat exchange means, fully warms therein and is discharged therefrom at substantially the delivery pressure.

2. The apparatus of claim 1, wherein:

said product is oxygen;

said air separation unit is a double column unit having higher and lower pressure columns operatively associated with one another by a condenser-reboiler located within a sump of the lower pressure column collecting liquid oxygen during operation of said double column unit.

3. The apparatus of claim 2, further comprising:

a subcooler connected to falling film evaporator, said air separation unit and said pump so that said subsidiary stream subcools by indirectly transferring heat to said product stream; and a joule-thompson valve to reduce air pressure of the subsidiary air stream to column pressure of said higher pressure column.

4. The apparatus of claim 2, wherein the phase separation tank is connected to the lower pressure column so that said liquid phase stream composed of the liquid phase flows into the lower pressure column.

5. A method of separating air to produce a product at a delivery pressure and enriched in a component of the air, said method comprising:

filtering an air stream composed of the air to be separated compressing the air stream;

removing heat of compression from the air stream;

purifying the air stream;

dividing the air into main and subsidiary air streams;

compressing the subsidiary air stream to a boosted pressure above the delivery pressure;

removing heat of compression from said subsidiary air stream;

cooling the main and subsidiary air streams so that at least said main air stream is cooled to a temperature suitable for its rectification;

separating the air contained within said main and subsidiary air streams within an air separation unit to produce the product as a liquid;

pumping a product stream composed of the liquid to the delivery pressure;

forming a falling film from the product stream and indirectly exchanging heat between said falling film with the air contained within said subsidiary air stream within a falling film evaporator so that said subsidiary air stream is further cooled while maintaining an essentially constant temperature difference between said air and said falling film;

the subsidiary air stream after having been further cooled being separated within said air separation unit;

an excess of falling film being supplied relative to the air within said falling film evaporator so that said product stream is partially vaporized within said falling film evaporator;

separating the partially vaporized product stream into liquid and vapor phases;

forming a vaporized product stream from the vaporized phase;

introducing a liquid phase stream composed of the liquid phase into said air separation unit; and fully warming and then discharging said vaporized product stream.

6. The method of claim 5, wherein:

the air is separated in a double column unit having a higher pressure column to refine the air and a lower pressure column to further refine the air into a nitrogen rich vapor fraction and an oxygen rich liquid fraction which comprises the product; and the product stream is formed from the oxygen rich liquid fraction.

7. The method of claim 6, wherein:

said subsidiary air stream is subcooled by indirect heat exchange with said product stream;

said subsidiary stream is reduced in pressure to operating pressure of the higher pressure column by an irreversible expansion; and said subsidiary stream is introduced into the higher pressure column.

8. The method of claim 7, wherein said liquid phase stream is introduced into said lower pressure column.

9. The method of claim 5 wherein said essentially constant temperature difference is in a range of between about 0.30K and about 1.0K.

* * * * *